US007100879B2

(12) United States Patent
Podue et al.

(10) Patent No.: US 7,100,879 B2
(45) Date of Patent: Sep. 5, 2006

(54) SPEAKER BRACKET

(75) Inventors: David R. Podue, Oceanside, CA (US); Timothy L. Ford, Vista, CA (US)

(73) Assignee: Dimension One Spas, Vista, CA (US)

( * ) Notice: Subject to any disclaimer, the term of this patent is extended or adjusted under 35 U.S.C. 154(b) by 0 days.

(21) Appl. No.: 10/328,782

(22) Filed: Dec. 23, 2002

(65) Prior Publication Data

US 2004/0099781 A1 May 27, 2004

Related U.S. Application Data

(63) Continuation-in-part of application No. 10/306,704, filed on Nov. 27, 2002, now Pat. No. 6,868,563, and a continuation-in-part of application No. 10/306,173, filed on Nov. 27, 2002.

(60) Provisional application No. 60/429,656, filed on Nov. 27, 2002.

(51) Int. Cl.
*A47B 96/06* (2006.01)

(52) U.S. Cl. ..... 248/220.31; 248/222.52; 381/87; 381/332; 403/348; 439/668; 439/948

(58) Field of Classification Search ..... 248/222.51, 248/222.52, 220.22, 220.31, 300, 222.11, 248/222.12, 222.13, 221.11; 381/87, 332, 381/334, 386, 387; 4/541.1; 439/948, 669, 439/668, 600; 403/348, 349, 13, 14
See application file for complete search history.

(56) References Cited

U.S. PATENT DOCUMENTS

| | | | | | |
|---|---|---|---|---|---|
| 2,355,913 | A | * | 8/1944 | Grunebaum | 439/338 |
| 3,523,267 | A | * | 8/1970 | Pauza | 439/329 |
| 3,585,991 | A | * | 6/1971 | Balamuth | 601/157 |
| 4,384,183 | A | * | 5/1983 | Meshoulam | 200/82 R |
| 4,475,226 | A | * | 10/1984 | Greenberg | 381/300 |
| 5,167,465 | A | * | 12/1992 | Inui et al. | 403/317 |
| 5,201,896 | A | | 4/1993 | Kruszewski | |
| D386,187 | S | | 11/1997 | Alsabrook, Sr. | |
| 5,730,409 | A | | 3/1998 | Baron et al. | |
| 6,138,969 | A | * | 10/2000 | Olausson | 248/222.52 |
| 6,146,191 | A | * | 11/2000 | Kerr et al. | 439/537 |
| D451,495 | S | | 12/2001 | McGurty | |
| 6,524,138 | B1 | * | 2/2003 | Li et al. | 439/669 |
| 6,608,909 | B1 | * | 8/2003 | Brady | 381/387 |
| 2003/0026445 | A1 | * | 2/2003 | Anderson | 381/386 |
| 2003/0088912 | A1 | | 5/2003 | Lauter et al. | |

FOREIGN PATENT DOCUMENTS

| | | | |
|---|---|---|---|
| GB | 2185655 | * | 7/1987 |

* cited by examiner

*Primary Examiner*—Korie Chan
(74) *Attorney, Agent, or Firm*—Fish & Richardson P.C.

(57) ABSTRACT

Systems and techniques to simply, easily and quickly attache and detach a speaker to a mounting location. A speaker bracket can provide a pivot point for the speaker that also serves as an audio signal connection point. The speaker bracket can be built in a robust fashion and can include a receptacle that is mounted on a surface, such as an indoor or outdoor wall, on the side of a pool or spa, or in any other suitable location. The speaker bracket can also include a support that can be attached and detached from the receptacle. When attached, the support rotates about the receptacle via a pivot point. A positioning mechanism can be included that allows the support to be removably fixed or locked into a desired position relative to the receptacle.

27 Claims, 5 Drawing Sheets

SPEAKER BRACKET

CROSS REFERENCE TO RELATED APPLICATIONS

This application claims the benefit of priority, under 35 USC 119(e)(1), from U.S. Provisional Application entitled "SPEAKER BRACKET," filed Nov. 27, 2002, Application Ser. No. 60/429,656; and U.S. and this application is a continuation-in-part application of and claims the benefit of priority, under 35 USC 120, to U.S. Application entitled "SPA-BASED SPEAKER," filed Nov. 27, 2002, Application Ser. No. 10/306,704 now U.S. Pat. No. 6,868,563; and this application is a continuation-in-part application of and claims the benefit of priority, under 35 USC 120, to U.S. Application entitled "WIRELESS AUDIO SYSTEM IN A SPA," filed Nov. 27, 2002, Application Ser. No. 10/306,173, which are hereby incorporated by reference.

BACKGROUND

The present application relates to brackets for supporting audio speakers.

Audio speakers may be used in indoor and outdoor applications, and speakers may be mounted on brackets. Traditional speaker brackets allow speakers to be moved into various positions and to be locked in place. In addition, audio speakers have been included in spas. Such conventional spa speakers are typically embedded in an interior surface wall of a spa and/or nestled into spa cabinetry.

SUMMARY

The present application includes systems and techniques relating to a simple, robust speaker bracket that allows a speaker to be attached and detached easily and quickly. A speaker bracket can provide a pivot point for the speaker that also serves as an audio signal connection point. The speaker bracket can include a receptacle that is mounted on a surface, such as an indoor or outdoor wall, on the side of a pool or spa, or in any other suitable location. The speaker bracket can also include a support that can be attached and detached from the receptacle. When attached, the support rotates about the receptacle via a pivot point. The support may be integral to an audio speaker, or the support may be separate from the speaker. In the latter case, any speaker may be manufactured or modified to attach to the support.

The speaker bracket includes a positioning mechanism that facilitates attaching and detaching of the support from the receptacle and allows the support to be removably and rotatably fixed in a desired position. The positioning mechanism can include a hole formed in the receptacle. The hole may be a standard ¼" female audio jack, wired to the audio system. The support can include a standard ¼" male audio plug that is inserted into the female jack on the receptacle. The male plug and female jack thus become the pivot point of the support, allowing the support to rotatably pivot relative to the receptacle, with the axis of rotation running through the male plug.

The positioning mechanism can also include at least one female tab with a detent formed on or as part of the receptacle, in which case the support has a corresponding male tab with a button. When the support is rotated about the pivot point, the button on the male tab engages the detent on the female tab, rotatably and removably fixing the support in place relative to the receptacle. Thus, the support and speaker can be rotated into a desired position and temporarily locked in place. By reversing the process (i.e., by rotating the support to disengage the locking mechanism and pulling the support outward, thereby removing the male plug from the female jack), the support and hence the speaker are easily detached from the receptacle.

The speaker bracket described herein can be used to mount a speaker on a wall, on a pool, or on a spa. The speaker bracket can allow the speaker to stand in a correct position, and the speaker bracket can be robust and resistant to breakage. In outdoor applications, the speaker bracket can stand up to exposure to the elements, such as cold, heat, humidity, and precipitation. At the same time, the speaker bracket can be low-cost. These advantages of the speaker bracket can be of particular value in outdoor applications, where speakers may be subject to collisions and to harsh elements, such as on the side of a pool or spa, and where pumping systems and water jets used to move water in the spa can generate a substantial amount of noise.

By mounting speakers on the side of a spa, the spa users can easily hear the audio generated by the speakers over such noise, but such placement of speakers can make the speakers subject to collisions with both people getting into and out of the spa and with the spa cover, which is typically a heavy, removable cover. Moreover, spas are frequently placed in cold weather environments, but at the same time generate substantial heat and humidity from the heated water circulating in the spa. In the heat of the summer or during other periods, however, the spa may go unused. As a result, a speaker bracket, such as described herein, that allows the speaker to rotate and to be quickly and easily removed can be very advantageous.

The receptacle and support structures of the speaker bracket can be made from sheet metal, contributing to the speaker bracket being low-cost and robust. Alternatively, other materials can be used for the receptacle and support, such as plastic or polymers, depending on environmental conditions, speaker weight, and cost constraints.

The details of one or more embodiments are set forth in the accompanying drawings and the description below. Other features and advantages may be apparent from the description and drawings.

DESCRIPTION OF DRAWINGS

Like reference symbols in the various drawings indicate like elements.

DETAILED DESCRIPTION

The present application describes systems and techniques relating to speaker brackets, such as may be used with a spa. As used herein, the term "spa" means a tub used for relaxation, invigoration, or health; the term "spa" includes free-standing spas, swim spas, and spas generally, regardless of size. A speaker bracket can include two pieces, a receptacle and a support, that can be rotatably and detachably connected to one another. The receptacle can be mounted on a surface, for example, a vertical surface such as a wall. The support is rotatably attached to the receptacle using a positioning mechanism. The positioning mechanism allows the support to be easily attached and detached from the receptacle and allows the support to be rotated about the receptacle. As part of the positioning system, a protrusion can be formed as part of the support, in which case the protrusion is inserted into a corresponding hole in the receptacle. The hole may also be extended into the wall on which the receptacle is mounted. The positioning mechanism may also include a means for rotatably and temporarily locking the support in a desired position relative to the receptacle.

Figure 1:
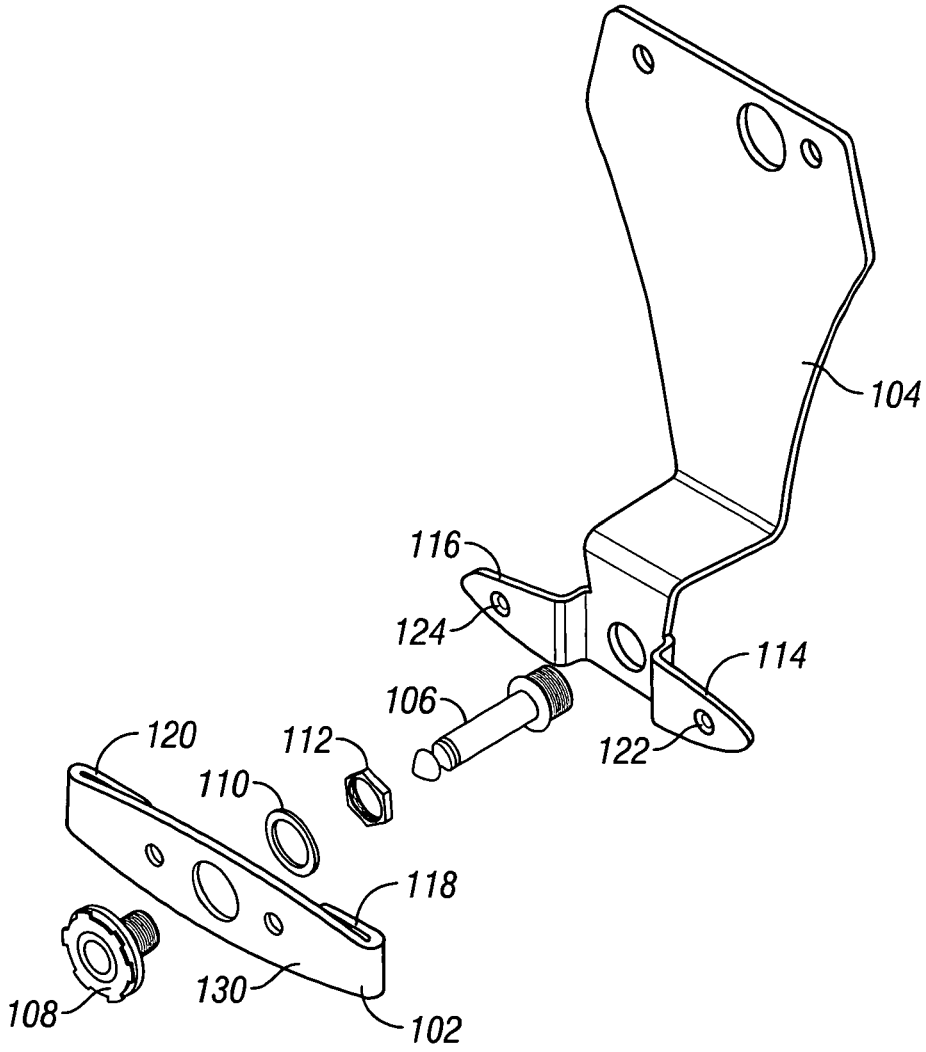
FIG. 1 is a perspective view of an example speaker bracket.

FIG. 1 shows an example speaker bracket 100. The speaker bracket can include a receptacle 102 and a support 104. The support 104 can have a protrusion 106, shown here as a ¼" standard male audio plug. The male plug 106 can be inserted into a corresponding hole 108 in the receptacle 102, shown here as a ¼" standard female audio jack. The female jack 108 may be affixed to the receptacle 102 using a washer 110 and a threaded nut 112. Similarly, the male plug 106 may be affixed to the support 104 using a washer and a threaded nut (not shown). Those skilled in the art will recognize that, alternatively, the male plug 106 and the female jack 108 may be affixed to the receptacle 102 and the support 104 using adhesive and friction, a grommet, or any other suitable means. In addition, those skilled in the art will recognize that the male plug 106 and female jack 108 need not be ¼" standard audio jacks, but could be any suitable audio connector, including RCA plugs, banana plugs, or a custom connector. Alternatively, an inactive (i.e., non-electrical) protrusion and hole could be substituted for the male plug 106 and female jack 108, and the audio connection between the support 104 and the receptacle 102 could be accomplished in another manner, such as by running wires from the receptacle 102 to the support 104. The protrusion could be part of the receptacle 102, and the support 104 could have the corresponding hole for accepting the protrusion.

The receptacle 102 and the support 104 can be made from sheet metal, making the speaker bracket 100 low-cost and robust. It will be understood, however, that the receptacle 102 and the support 104 may be made from other materials as well. Suitable alternative materials include plastic, polymer, aluminum, or titanium, depending on environmental conditions, speaker weight, and cost constraints. Any of these materials will work, provided the receptacle 102 and the support 104 are made of any flexible material that is sufficiently rigid to support shear. Many polymers meet this requirement, meaning the receptacle 102 and the support 104 can be made by injection molding, compression molding, or thermoforming. In addition, the receptacle 102 and support 104 can each be made from different materials, for example, a sheet metal receptacle and polymer support. Furthermore, a mixture of materials could be used on either of the receptacle 102 or support 104.

As shown in FIG. 1, the receptacle 102 and support 104 can include a positioning mechanism that includes the male plug 106, the female jack 108, at least one male tab on the support 104 (two male tabs 114 and 116 are shown), and at least one corresponding female tab on the receptacle 102 (two female tabs 118 and 120 are shown). Each male tab 114, 116 on the support 104 can include a button 122, 124, while each female tab 118, 120 on the receptacle 102 can include a corresponding detent 126, 128 (shown in FIGS. 2A–2C).

Figure 2A:
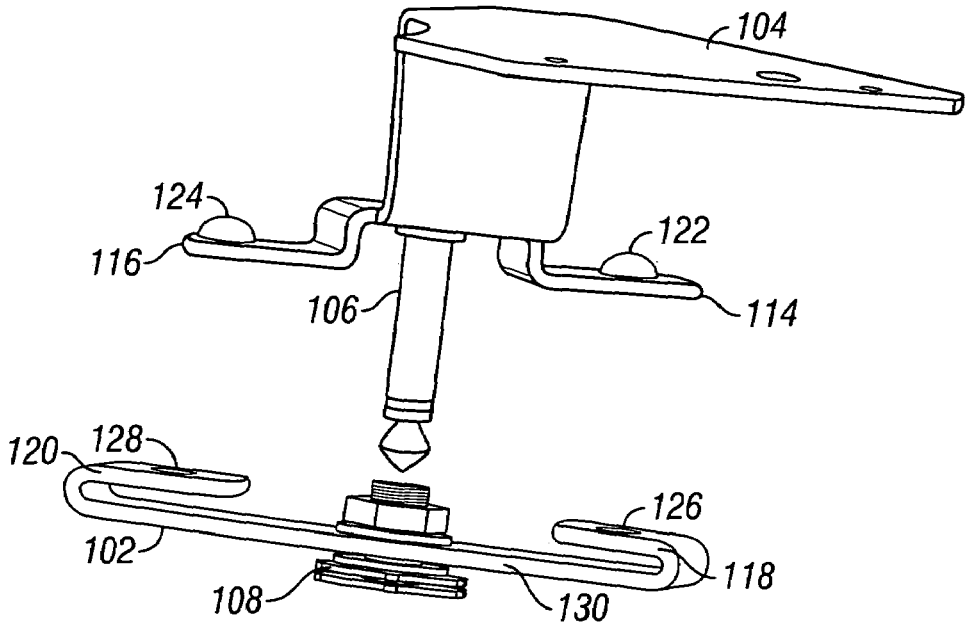
FIGS. 2A–2C illustrate the process for attaching a support to a receptacle for the embodiment of FIG. 1.
Figure 2B:
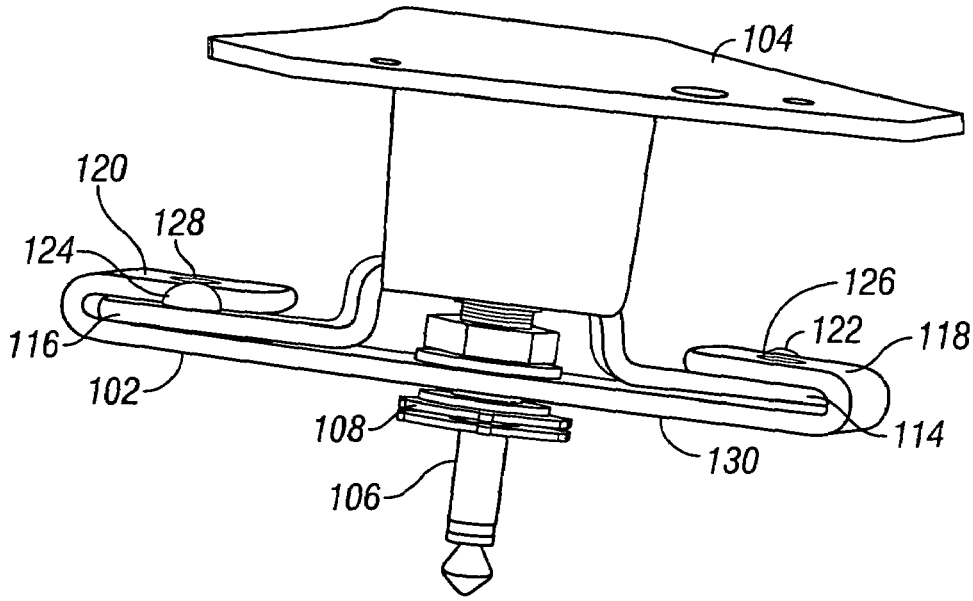
Figure 2C:
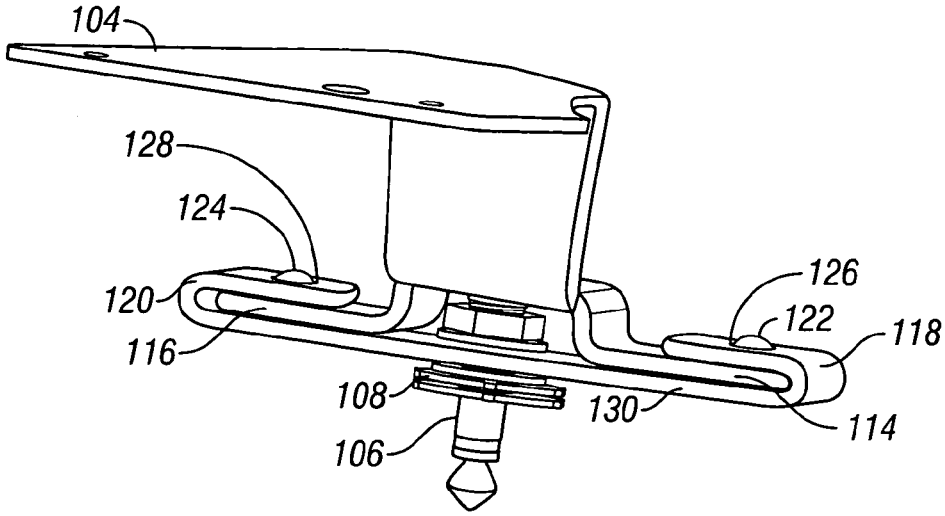

FIGS. 2A–2C illustrate a technique for rotatably attaching the speaker bracket 100, including operation of an exemplary positioning mechanism. FIG. 2A shows the support 104 and the receptacle 102 prior to attachment. As can be seen in FIG. 2A, the support 104 is positioned relative to the receptacle 102 such that the male tabs 114, 116 are not aligned with the female tabs 118, 120. Then, as shown in FIG. 2B, the male plug 106 on the support 104 is fully inserted into the opening in the female jack 108 on the receptacle 102. Because the male tabs 114, 116 and female tabs 118, 120 are not aligned with each other, the male plug 106 may be inserted fully into the female jack 108. Once insertion is complete, the support 104 may be rotated relative to the receptacle 102 about a pivot point located at the male plug 106 and female jack 108, bringing the male tabs 114, 116 and female tabs 118, 120 into alignment with each other, and allowing the buttons 122, 124 to engage the detents 126, 128, as shown in FIG. 2C. The support 104 is thus rotatably positioned and removably locked into a desired position relative to the receptacle 102.

In FIG. 2C, the male tabs 114, 116 are shown sandwiched between the female tabs 118, 120 and the back 130 of the receptacle 102. Alternatively, one of the male tabs 114 or 116 could be sandwiched between the corresponding one of the female tabs 118 or 120 and the receptacle back 130, while the other male tab 114 or 116 could be above its corresponding female tab 118 or 120, with the button 122 or 124 being formed on the underside of the male tab 118 or 120. This configuration is shown in FIGS. 4 and 5A–5C.

Those skilled in the art will recognize that a positioning mechanism that includes at least one male tab 114, 116, at least one female tab 118, 120, at least one button 112, 124, and at least one detent 126, 128 is merely exemplary. Alternative positioning mechanisms could be employed. For example, instead of providing the female tabs 118, 120, a hole could be formed through each male tab 114, 116 (for example, at the location of the buttons 122, 124), and a screw inserted through each hole and into a corresponding female threaded hole in the receptacle 102, thereby rotationally and removably locking the support 104 in place relative to the receptacle 102. As another alternative, one or more threaded screws (optionally, with a hand-twistable knob) could be inserted through a hole in the support 104 and screwed into corresponding threaded holes in the receptacle 102. With the screw tightened down sufficiently, the support can be temporarily locked into a desired position based on friction between the support 104 and the receptacle 102; in addition, a button/detent system could be employed with the screw to align and further secure the support 104 into the desired position. These alternative positioning mechanisms are but two examples; other mechanisms could be used to fix the position of the support 104 relative to the receptacle 102. For example, a hole and alignment pin could be used, or a radial cam and follower, a barrel cam and follower, a notch and gap, a spring loaded catch pin, or a gear and lever. In fact, as those skilled in the art will appreciate, nearly any radial positioning device can be employed.

The remainder of the description will be in the context of a spa. However, as described above, the speaker bracket is not limited to use on a spa, and can be used to mount a speaker on essentially any flat surface, and particularly on vertical walls.

Figure 3:
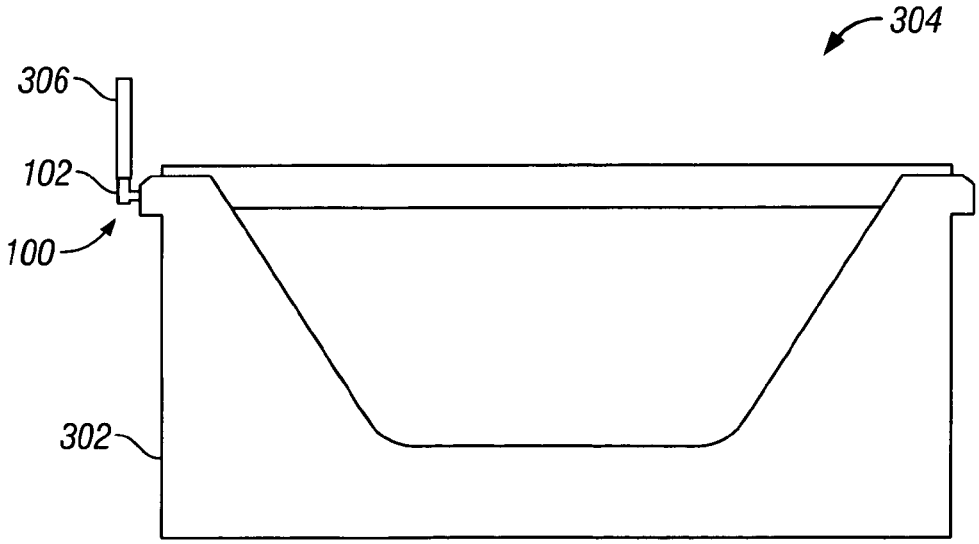
FIG. 3 is a cut-away side view of a spa with an example detachable, rotatable speaker.

FIG. 3 illustrates the speaker bracket 100 mounted on a vertical wall 302 of a spa 304. The speaker bracket 100 is attached to the vertical wall 302, and a speaker 306 is attached to the speaker bracket 100. The support 104 of the bracket 100 is positioned essentially vertically, such that the speaker 306 extends over the top of the spa 304, proximally locating the speaker 306 relative to persons sitting in the spa 304 and allowing the sound generated by the speaker 306 to be heard clearly over the noise of the pumping system in the spa 304.

Figure 4:
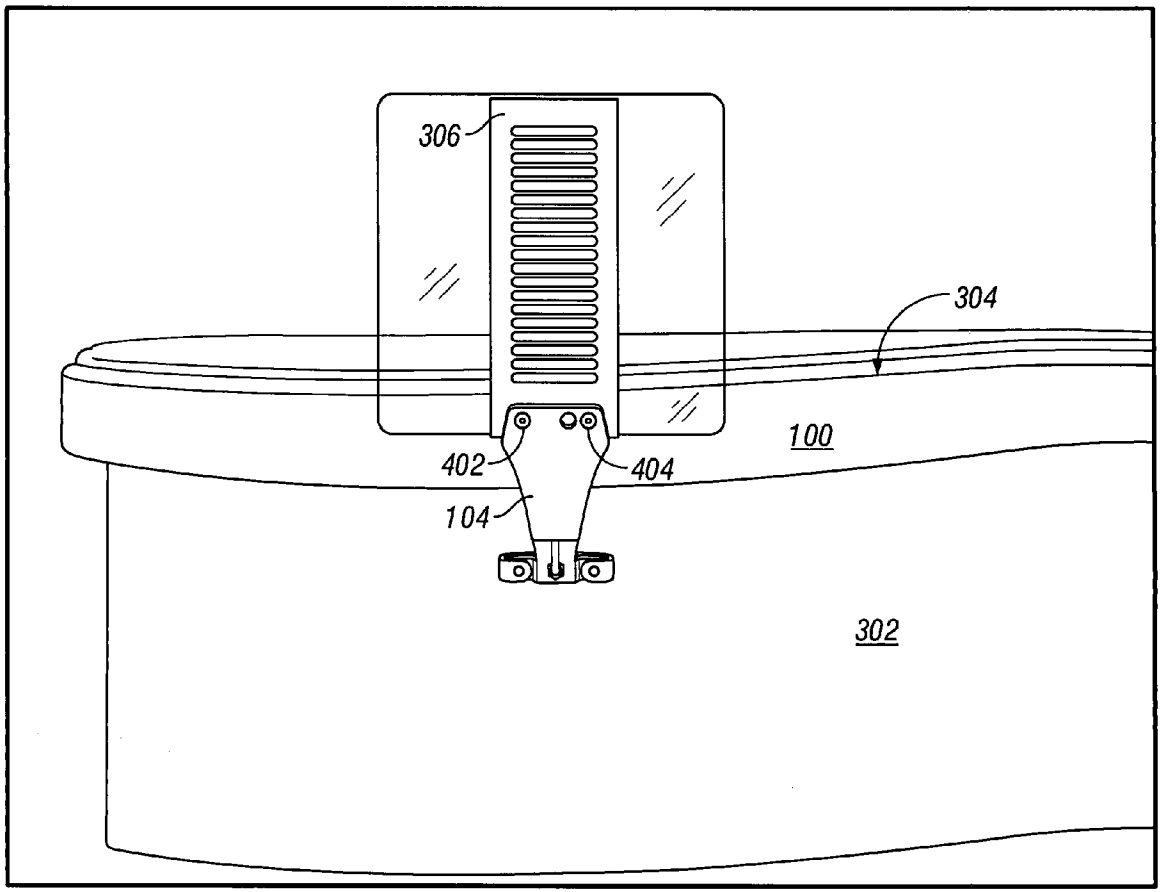
FIG. 4 shows a speaker attached to a spa in accordance with one embodiment.
Figure 5A:
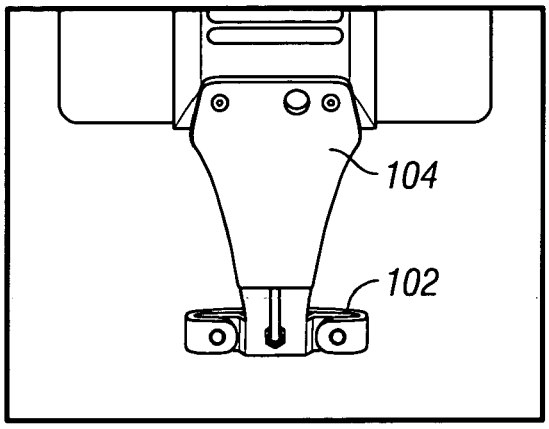
FIGS. 5A–5C illustrate the process for detaching a support and speaker from a receptacle, in accordance with the embodiment of FIG. 4.

FIG. 4 shows the exemplary speaker bracket 100 in greater detail mounted on the vertical wall 302 of the spa 304. The receptacle 102 can be affixed to the vertical wall 302 of the spa 304, such that the long axis of the receptacle 102 is substantially horizontal to the floor. A speaker 306 can be attached to the support 104. The speaker 306 may be a separate unit attached to the support 104, or the support 104 may be integrally formed as part of the speaker 306. Those skilled in the art will appreciate that, if not integral, the speaker 306 may be attached to the support 104 in many different ways, for example, rivets, nuts and bolts, adhesive, etc. In FIG. 4, rivets 402, 404 are used. FIG. 5A shows the exemplary speaker bracket 100 in a "nested" or "locked" position, in which the buttons 122, 124 are removably engaged in the detents 126, 128. In the locked position, the support 104 is upright, with its long axis essentially perpendicular to the long axis of the receptacle 102. By "locked," it is intended that the support 104 can also be "unlocked," to allow removal of the support 104 from the receptacle 102.

Figure 5B:
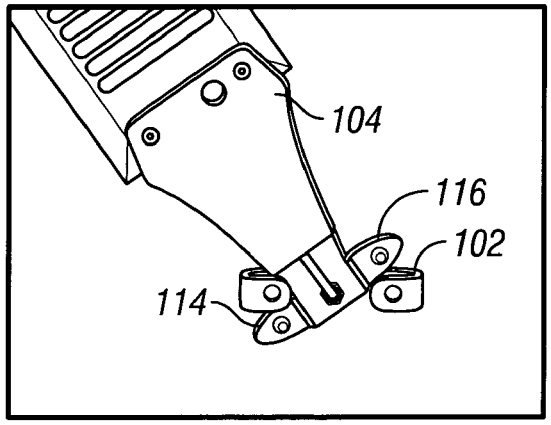
Figure 5C:
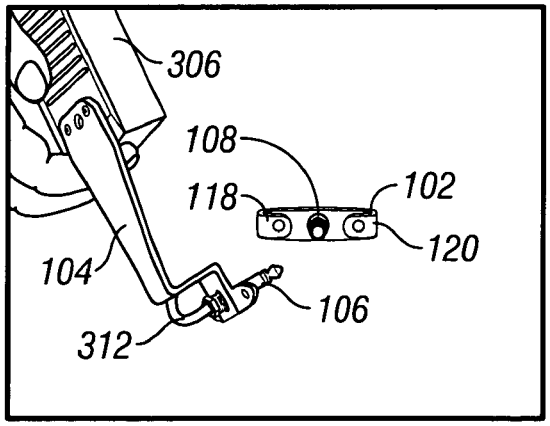

FIGS. 5A–5C illustrate the technique for removing the support 104 from the receptacle 102 in the exemplary embodiment of the speaker bracket 100. FIG. 5A shows the speaker bracket 100 in the locked position. FIG. 5B shows the support 104 and attached speaker 306 being rotated (or twisted) so as to disengage the male tabs 114, 116 from the female tabs 118, 120 and hence the buttons 122, 124 from the detents 126, 128. Once the male tabs 114, 116 and female tabs 118, 120 and buttons 122, 124 and detents 126, 128 are disengaged, the support 104 can be removed from the receptacle 102 by pulling outward on the support 104, disengaging the male plug 106 from the female jack 108, as shown in FIG. 5C. As can also be seen in FIG. 5C, audio wiring 312 extends from the back of the male plug 106 and is connected to the speaker 306. Within the spa, the female jack 108 is likewise connected by wiring to the audio source that drives the speaker 306. The audio source may be a radio, CD player, tape player, DVD player, or any other source of audio.

A number of embodiments have been described. Nevertheless, it will be understood that various other embodiments and modifications are also possible. For example, the positioning mechanism may include the male tabs 114, 116 with buttons 122, 124 and the female tabs 118, 120 with detents 126, 128, or, as described above, the male tabs 114, 116 could have holes instead of the buttons 112, 124, and screws could pass through the holes and into threaded holes in the receptacle 102, dispending with the female tabs 118, 120 and detents 126, 128. Alternatively, other positioning mechanisms could be used. The receptacle 102 and support 104 may be made from sheet metal, but, as described above, other suitable materials could be used, including plastics and polymers. Accordingly, other embodiments are within the scope of the following claims.

What is claimed is:

1. A speaker bracket, comprising:

a receptacle having a hole; and a support for holding a speaker, the support including:

a protrusion for inserting into the hole and for rotatably and removably attaching the support to the receptacle, and a first mechanism for rotatably and removably locking the support relative to the receptacle with a single rotating action, wherein the receptacle further includes a second mechanism for engaging the first mechanism and for rotatably and removably locking the support relative to the receptacle, and the first mechanism includes a button on at least one first tab extending in a direction parallel with an axis of rotation of the support to look the support relative to the receptacle upon the single rotating action, wherein the second mechanism includes at least one second tab and a detent the first tab for engaging the second tab and for rotatably and removably locking the support relative to the receptacle, and wherein the first tab engages the second tab with the button and the detent, the button and detent assisting in rotatably and removably locking the support relative to the receptacle.

2. The speaker bracket of claim 1 further comprising the speaker being integral to the support.

3. The speaker bracket of claim 1 wherein the support is configured to be a separate part from the speaker.

4. The speaker bracket of claim 1 wherein the hole includes a female audio jack and the protrusion includes a male audio plug.

5. The speaker bracket of claim 4 wherein the male audio plug is for inserting into the female audio jack, the support for rotatably pivoting about the axis of the male audio plug when the male audio plug is inserted into the female audio jack.

6. The speaker bracket of claim 5 wherein the female audio jack is a ¼inch female audio jack and the male audio plug is a ¼inch male audio plug.

7. The speaker bracket of claim 1 wherein the receptacle and the support are made at least in part from sheet metal.

8. The speaker bracket of claim 1 wherein the receptacle is for affixing to a substantially vertical wall of a spa.

9. The speaker bracket of claim 1, wherein the first mechanism comprises a full 360 degrees of rotation relative to the receptacle.

10. The speaker bracket of claim 1, wherein the support is configured to hold the speaker with a tight profile to a spa.

11. A speaker bracket, comprising:

a receptacle having a hole; and a support for holding a speaker, the support including:

a protrusion for inserting into the hole and for rotatably and removably attaching the support to the receptacle, and a first mechanism for rotatably and removably locking the support relative to the receptacle with a single rotating action, wherein the receptacle further includes a second mechanism for engaging the first mechanism and for rotatably and removably locking the support relative to the receptacle, and the first mechanism includes opposing tabs each with a button extending in a direction parallel with an axis of rotation of the support to lock the support relative to the receptacle upon the single rotating action, wherein the second mechanism includes opposing tabs and detent, the opposing tabs of the first mechanism for engaging the opposing tabs of the second mechanism and for rotatably and removably locking the support relative to the receptacle, and wherein the opposing tabs of the first mechanism engage the opposing tabs of the second mechanism with the buttons and detents, the buttons and detents assisting in rotatably and removably locking the support relative to the receptacle.

12. The speaker bracket of claim 11 further comprising the speaker being integral to the support.

13. The speaker bracket of claim 11 wherein the support is configured to be a separate part from the speaker.

14. The speaker bracket of claim 11 wherein the hole includes a female audio jack and the protrusion includes a male audio plug.

15. The speaker bracket of claim 11 wherein the receptacle and the support are made at least in part from sheet metal.

16. The speaker bracket of claim 11 wherein the receptacle is for affixing to a substantially vertical wall of a spa.

17. The speaker bracket of claim 11 wherein the first mechanism comprises a full 360 degrees of rotation relative to the receptacle.

18. The speaker bracket of claim 11 wherein the support is configured to hold the speaker with a tight profile to a spa.

19. A speaker bracket, comprising:

a receptacle having a hole;

a support for holding a speaker, the support including a protrusion for inserting into the hoie and for rotatably and removably attaching the support to the receptacle; and a positioning mechanism for rotatably and removably locking the support relative to the receptacle with a single rotating action, wherein the positioning mechanism includes a first tab associated with the support and a second tab associated with the receptacle and a detent associated with the second tab, the first tab for engaging the second tab and for rotatably and removably locking the support relative to the receptacle, the first tab including a button that extends in a direction parallel with an axis of rotation of the support to lock the support relative to the receptacle upon the single rotating action, and wherein the first tab and second tab engage one another at least in part with the button and the detent.

20. The speaker bracket of claim 19 wherein the hole includes a female audio jack and to protrusion includes a male audio plug.

21. The speaker bracket of claim 20 wherein the female audio jack is a ¼inch female audio jack and the male audio plug is a ¼inch male audio plug.

22. The speaker bracket of claim 19 wherein the receptacle and the support are made at least in part from sheet metal.

23. The speaker bracket of claim 19 further comprising the speaker being integral to the support.

24. The speaker bracket of claim 19 wherein the support is configured to be a separate part from the speaker.

25. The speaker bracket of claim 19 wherein the receptacle is for affixing to a substantially vertical wall of a spa.

26. The speaker bracket of claim 19 wherein the positioning mechanism allows a full 360 degrees of rotation relative to the receptacle.

27. The speaker bracket of claim 19 wherein the support is configured to hold the speaker wit a tight profile to a spa.

* * * * *